United States Patent [19]

Greenberg

[11] Patent Number: 5,016,289

[45] Date of Patent: May 21, 1991

[54] EPAULET STIFFENER

[75] Inventor: Jack Greenberg, Stamford, Conn.

[73] Assignee: DME Industries, Inc., New York, N.Y.

[21] Appl. No.: 417,085

[22] Filed: Oct. 4, 1989

[51] Int. Cl.[5] ..... A41D 27/08; A41D 29/00

[52] U.S. Cl. ..... 2/246; 2/244; 2/260; 2/264

[58] Field of Search ..... 2/217, 218, 244, 246, 2/250, 255, 256, 257, 258, 259, 260, 261, 264, 268; 223/63, 65, 72, 75, 78, 83, 84

[56] References Cited

U.S. PATENT DOCUMENTS

| | | | |
|---|---|---|---|
| 33,702 | 11/1861 | Gray | 2/246 |
| 107,614 | 9/1870 | Helwig | 2/246 |
| 111,456 | 1/1871 | Horshmann | 2/246 |
| 145,661 | 12/1873 | Kyser . | |
| 389,637 | 9/1888 | Byers . | |
| 546,422 | 9/1895 | Gregory | 223/63 |
| 607,766 | 7/1898 | Riley | 2/250 |
| 797,158 | 8/1905 | Vance | 2/250 X |
| 1,102,029 | 6/1914 | Fitzgerald | 223/65 X |
| 2,211,023 | 8/1940 | Murphy | 2/250 |
| 2,219,773 | 10/1940 | Gutermuth | 223/75 |
| 2,272,051 | 2/1942 | Phelps | 223/65 |
| 2,433,623 | 12/1947 | Perlmutter . | |
| 2,440,121 | 4/1948 | Schwartz . | |
| 2,488,617 | 11/1949 | Butcher | 223/63 |
| 2,596,842 | 3/1950 | Despres . | |
| 2,678,445 | 5/1954 | Tagliero | 2/256 |
| 2,856,107 | 10/1958 | Shiller | 223/65 |
| 2,868,424 | 1/1959 | Helton | 223/63 |

FOREIGN PATENT DOCUMENTS

| | | | |
|---|---|---|---|
| 13261 | of 1928 | Australia . | |
| 647122 | 7/1928 | France | 223/65 |
| 779984 | 4/1935 | France | 223/65 |
| 1072724 | 9/1954 | France | 2/246 |

*Primary Examiner*—Werner H. Schroeder
*Assistant Examiner*—Jeanette E. Chapman
*Attorney, Agent, or Firm*—Oliff & Berridge

[57] ABSTRACT

A removable and economical stiffener comprises a spring wire frame having a base member which resiliently biases two depending side members so as to maintain an epaulet in a relatively taut, planar condition.

4 Claims, 1 Drawing Sheet

EPAULET STIFFENER

FIELD OF THE INVENTION

This invention is directed generally to stiffeners for epaulets worn on clothing, and more particularly to removable wire stiffeners for uniform epaulets.

BACKGROUND OF THE INVENTION

Shoulder epaulets have been used for many years, particularly to carry insignia on uniforms. It is common practice to employ a stiffening member within an epaulet to make it rigid and thereby prevent buckling and wrinkling of the epaulet which would detract from its appearance. For this purpose, treated cloth or plastic stiffening sheets have been used. However, such stiffeners cause discomfort to the wearer.

In addition, such stiffening elements are usually incorporated directly into the epaulet and either are not removable or are difficult to remove when the garment or the epaulet or loss of stiffening by the stiffening member.

SUMMARY OF THE INVENTION

It is accordingly a principal object of the present invention to provide an improved epaulet stiffener which prevents discomfort to the wearer but which is still effective in maintaining the tautness, and thus the neat appearance of the epaulet during wear.

It is further object of the present invention to provide an improved epaulet stiffener which is readily inserted in and removed from the epaulet.

It is a still further object of the present invention to provide an improved epaulet stiffener which is simple in construction, economical to manufacture, and suitable for different size epaulets.

These and other objects are achieved in accordance with the present invention by an epaulet stiffener comprising a spring wire frame which is insertable inside the epaulet. Resilient legs of the frame urge opposed edges of the epaulet outward and the epaulet assumes a taut condition. The spring wire frame is inserted or removed from the epaulet by urging the resiliently opposed legs of the frame together.

These and other objects, features and advantages of the present invention are described in or apparent from the following detailed description of a preferred embodiment.

DESCRIPTION OF THE DRAWINGS

The preferred embodiment will be described with reference to the drawings, in which.

DESCRIPTION OF THE PREFERRED EMBODIMENT

Figure 1:
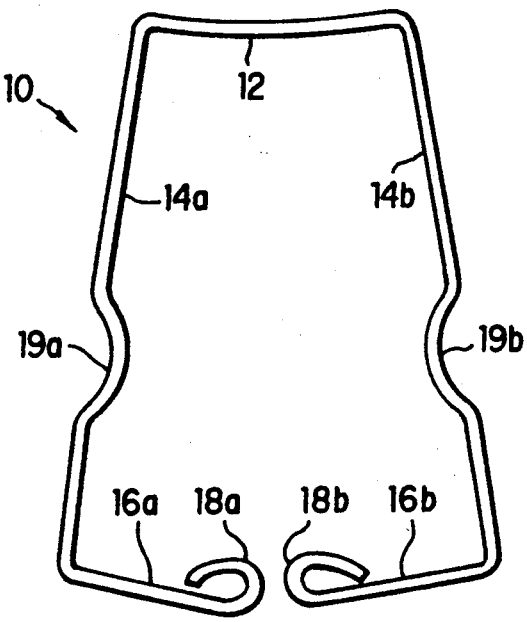
FIG. 1 is a plan view of a stiffening frame member according to the invention in unrestrained condition.

FIG. 1 shows a stiffening member 10 in the form of a substantially planar wire frame. Stiffening member 10 in FIG. 1 is in an unrestrained condition. Stiffening member 10 may be made of a wide variety of suitable materials, the most effective material being spring steel wire.

The stiffening member 10 includes a transverse base member 12. When stiffening member 10 is not tensioned, the base member has a slightly arcuate shape. A pair of opposed leg members 14*a* and 14*b* are joined to opposite ends of the base member 12 and extend angularly therefrom in a flared relationship, as shown, in the untensioned state of stiffening member 10. The free ends of the legs 14*a*, 14*b* carry end sections 16*a*, 16*b*, respectively, which extend inwardly toward the longitudinal axis of the frame. The ends of the sections 16*a*, 16*b* are terminated by bends 18*a*, 18*b*, respectively, which are included to minimize snagging or damage to the cloth epaulet. Opposed arcuate depressions 19*a*, 19*b* in legs 14*a*, 14*b* serve as finger engagement points along the legs.

Figure 2:
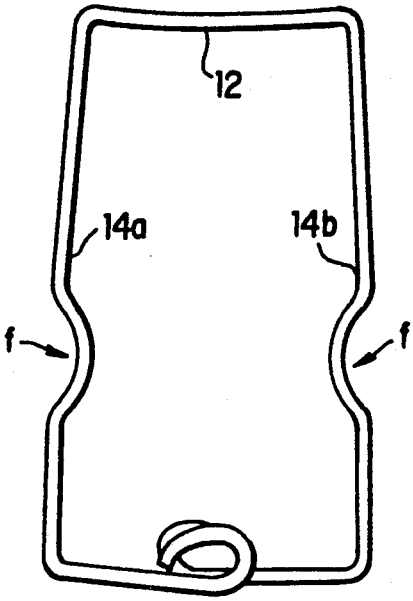
FIG. 2 illustrates the frame member of FIG. 1 in a compressed condition.

FIG. 2 shows the condition of the stiffening member 10 when opposed laterally inwardly directed forces f urge the free ends of the legs 14*a*, 14*b* toward the longitudinal center line of the frame. Under these conditions, stiffening member 10 has a substantially rectangular frame shape. The base 12 assumes a less arcuate shape and serves to resiliently bias the legs 14*a*, 14*b* outwardly.

Figure 3:
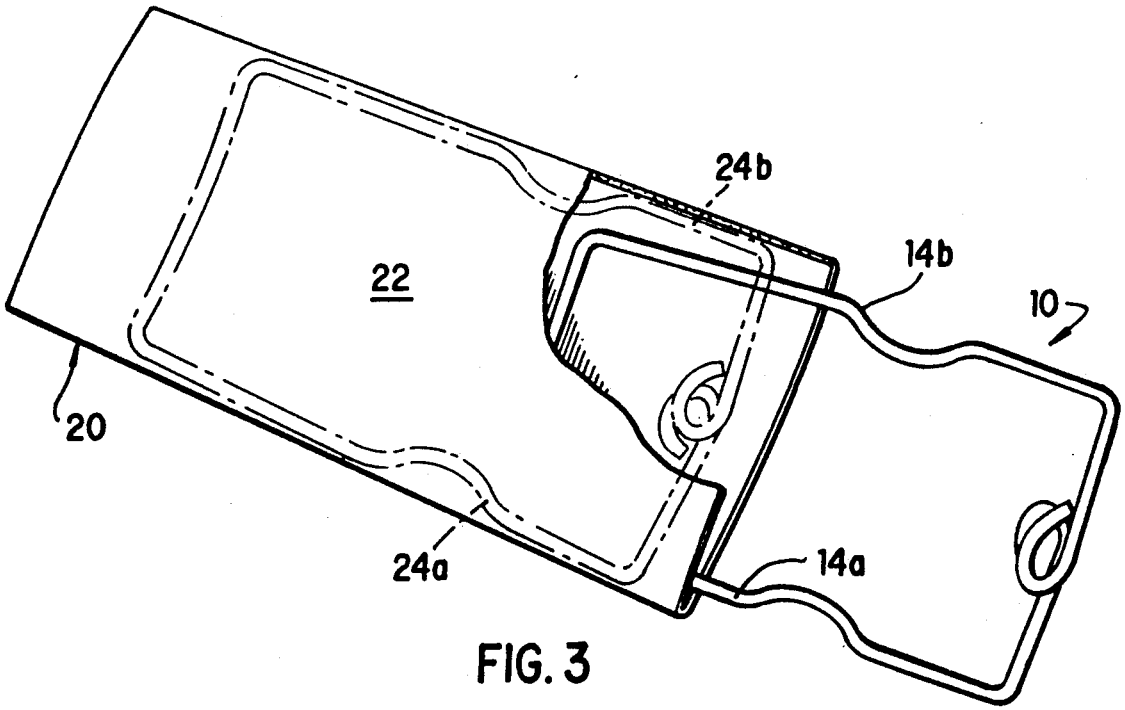
FIG. 3 is a partial cutaway view of an epaulet showing insertion or removal and positioning of the stiffening frame member within the epaulet.

Referring to FIG. 3, an epaulet 20 is shown having a hollow body 22 into the interior of which stiffening member 10 is inserted. The upper surface of the body 22 can carry suitable ornamentations such as military insignia (not shown). Epaulet 20 is made of suitable material, usually a piece of cloth which has been sewn with a longitudinal seam to form body 22.

In order to stiffen the epaulet body 22, stiffening member 10 is placed in the condition shown in FIG. 2 by engaging stiffening member 10 at depression 19*a*, 19*b* and moving the leg members 14*a*, 14*b* together. In this condition, the stiffening member is slipped inside the epaulet body 22. When the stiffening member is released, the spring bias imparted by the base member 12 urges the legs 14*a*, 14*b* outwardly against inside edges 24*a*, 24*b* of the epaulet body. Stiffening member 10 is sized relative to the body 22 so that when it is inside the epaulet body, it is restrained from achieving the unconfined shape shown in FIG. 1, thus forming a frame which maintains a constant tension within the body 22. Epaulet 20 is thus maintained in a taut condition. Removal of the frame 22 is accomplished by reversing the insertion steps.

Preferably, stiffening member 10 is somewhat shorter longitudinally than the epaulet body 22, so that the ends of the stiffening member are hidden within epaulet 20.

The construction just described results in a lightweight epaulet stiffener having a substantially open central area which is capable of conforming to the shoulder surfaces of the wearer, thereby making the epaulet more comfortable to wear. Further, the stiffener is easily and quickly removable, and is very economical to manufacture.

It will be appreciated that the disclosed preferred embodiment is merely illustrative of the present invention, and that changes and modifications can be made without departing from the spirit and scope of the invention.

What is claimed is:

1. An epaulet adapted to be mounted on the shoulder of a garment comprising:

a tubular, non-rigid, elongate body of sheet material adapted to form a substantially rectilinear, planar surface disposed between opposed lateral edges; and means for stiffening said body of sheet material comprising a resilient wire frame mounted within said tubular body, said frame having an elongate base member of a length substantially equal to the distance between said opposed lateral edges when said surface is substantially planar, a leg extending angularly from each end of the base member in substantially the same direction as each opposed lateral edge and defining therebetween an open space, each leg being of a length less than the length of the side edge of said body along which said leg is disposed and having a free distal end disposed away from the base member;

said base member resiliently biasing each leg transversely outwardly to cause said planar surface of the body to assume a stiffened, planar condition;

said base member and legs being substantially coplanar and said base member having an arcuate section when said frame is in unrestrained condition;

said arcuate section extending toward said open space.

2. An epaulet as in claim 1, wherein the body is cloth.

3. An epaulet as in claim 1, wherein the wire is spring wire.

4. An epaulet as in claim 1, wherein the distal end of each leg includes a portion extending inwardly toward a central longitudinal axis of the frame.

* * * * *